US005594193A

United States Patent [19]

Sheridan

[11] Patent Number: 5,594,193

[45] Date of Patent: Jan. 14, 1997

[54] BULLET PROOF SHIELD FOR VEHICLE WINDOWS

[76] Inventor: Ronald J. Sheridan, 1890 Tropic St., Titusville, Fla. 32796

[21] Appl. No.: 496,521

[22] Filed: Jun. 29, 1995

[51] Int. Cl.[6] ..... F41H 5/013; F41H 5/06

[52] U.S. Cl. ..... 89/36.08; 109/49.5

[58] Field of Search ..... 89/36.08, 36.02, 89/36.07; 109/49.5; 296/152

[56] References Cited

U.S. PATENT DOCUMENTS 2,917,111 12/1959 Clarke ..... 296/152

3,855,898 12/1974 McDonald ..... 109/49.5

5,271,311 12/1993 Madden, Jr. ..... 89/36.08

*Primary Examiner*—Stephen M. Johnson

*Attorney, Agent, or Firm*—John B. Dickman, III

[57] ABSTRACT

A vehicle window shield of a projectile resistant plastic material having upper and lower supports to mount the window shield in the window opening of a vehicle door. The upper supports adjust to engage the window channel of the door and the lower supports have hook shaped ends which engage slots in the door sill that within which the window reciprocates. The hook shaped end prevents the window shield from being removed without tilting it to one side, even if the upper supports are disengaged from the channel.

4 Claims, 1 Drawing Sheet

BULLET PROOF SHIELD FOR VEHICLE WINDOWS

BACKGROUND OF THE INVENTION

The present invention relates to a vehicle protective window and, in particular, to a vehicle protective window that is bullet resistant and mounts inside a vehicle side window on the door frame.

Making a vehicle bullet proof using steel plates and very thick safety glass is well known. Applications of such armor proof vehicles range from the protection of Presidents and highly visible wealthy people to military personnel. It is expensive to construct armor proof vehicles, and because of the additional weight, such vehicles are more costly to own and operate. They require heavier tires, heavy duty suspension systems, and added gasoline consumption just to mention some of the costly items.

Steel plated armored vehicles do not take into account the windshield and side windows. It is possible when armor-plating a vehicle from the ground up to install heavier transparent plastics such as aliphatic and alicyclic urethanes, plexiglas, polycarbonates and others are well known for use as projectile resistant windows.

Vehicles which have been in service present an altogether different problem of protection of passengers from the violence occuring in many of the towns and cities around the world. It has been suggested in the prior art to provide after market protective panels for vehicle doors and windows. The entire inside of each door may be covered with projectile resistant transparent plastic panels. Each panel can be permanently attached to a door, forming a shield from the vehicle floor to the headliner.

While the prior art addresses the dangerous situation present in most urban areas, most people would not want to have full armor protection at all times. The concern is having permanently, or nearly so, installed transparent plastic panels. Also, the plastic panels detract from the interior, and could be demoralizing and demeaning. Further, encasing the interior with armor is cumbersome and confining to some people. However, ordinary people do occasionally enter dangerous areas where such protection is prudent. On those occasions a removable or permanently installed window protection does offer security.

The present invention overcomes the prior art problems associated with providing armor protection for vehicles already in service. Most urban situations involving guns, include criminal element which is inexperienced in marksmanship. Often the criminals use small caliber automatic weapons that they randomly shoot. The most critical areas of the body to protect are the upper body and head; therefore, a window shield which covers those vital areas is paramount. The window shield of the present invention does just that.

SUMMARY OF THE INVENTION

The invention herein described and claimed comprises a projectile resistant window shield of transparent material which may be easily secured to and removed from a vehicle. The window shield is placed adjacent to the side door window and secured by top and bottom door window fasteners which connect to a window channel.

A transparent plastic material that is capable of resisting projectiles is used in the window shield. Of course, the plastic material can be tinted which would render the driver and the passengers more difficult to aim at.

The fasteners function to adapt the window shield to most window sizes and dimensions. The top fasteners comprise a pair of vertical slides which adjust vertically to engage the window channel.

The bottom fasteners are spaced apart, each having hook-like ends to engage inside of the window channel which forms part of the door sill.

It is an object of the present invention to provide a new and useful removable projectile resistant window shield that is transparent, and which may be relatively easily secured to and removed from a vehicle. No tools to install and remove the shields.

DESCRIPTION OF THE INVENTION

Figure 1:
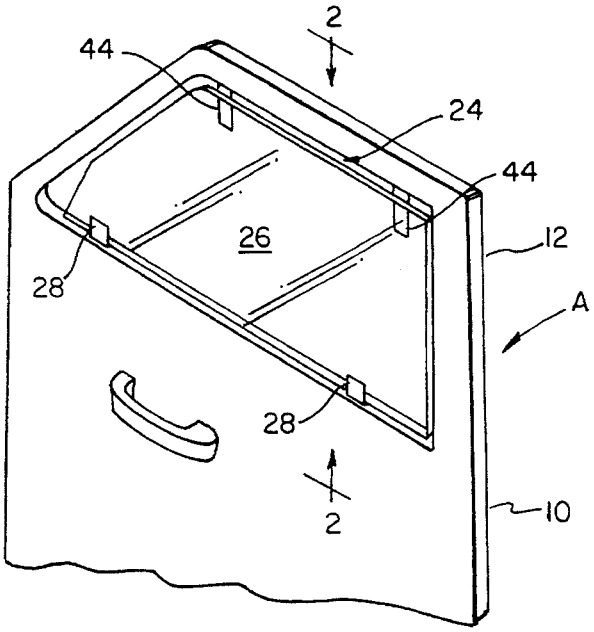
FIG. 1 is a perspective view of a vehicle door showing a window shield of the invention.

Referring to the drawings FIGS. 1–7, there is shown in FIG. 1, a vehicle door 10, having a window frame 12 and a window channel 14. The window channel 14 is a recess in door window frame 12 and has a rubber weatherproof gasket 16 that seals a vertically movable window 18, shown in FIG. 2. Bottom end 20 of door window frame 12 does not have a channel 14, instead there is a slot 22 which window 18 moves through. Window frame 12 forms a window opening 24 that is normally opened or closed by window 18. FIG. 1 shows a transparent projectile resistant window shield 26 mounted in window opening 24 and supported in window channel 14.

Window shield 26 is made of transparent projectile resistant plastic material. This plastic material is an aliphatic or alicyclic urethane, plexiglas, polycarbonate or other modern plastic suitable as a bullet or projectile resistant material. Bullet resistant glass may also be used.

A pair of stationary supports 28 is fixed to lower end 30 of window shield 26 by a fastener means 32. Stationary supports 28 are spaced apart on lower end 30 to hook in door frame slot 22. Each support 28 has a vertical section 34, a horizontal section 36 that is at a right angle to section 34, and a downwardly projecting section 38. Projecting section 38 is coated with a flocking 40B or other coating material for protection of the glass and for shock absorbing purposes. Also, projecting section 38 has a curved end 40 which hooks in the door frame slot 22. The curved end 40 is inserted between door frame member 42 and window 18 in slot 22. The window shield 26 is tilted in the direction of arrow A so curve end 40 will fit between member 42 and window 18. As the window shield 26 is raised, the curved end 40 hooks under member 42. Once in place, the window shield 26 can only be removed by reversing the procedure. Another purpose for the curved end 40 is to allow window 18 to move up and down without binding on the support. The window top edge and side surface rub against the arcuate surface of curved end 40 to freely move up and down. The stationary supports 28 are secured to the window shield by fasteners 32, which can be a nut and bolt, a rivet means or some other fastener.

Figure 2:
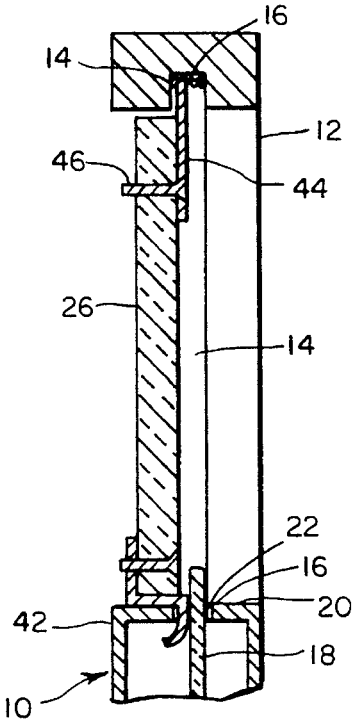
FIG. 2 is a cross-section view taken along the line 2—2 of FIG. 1.
Figure 3:
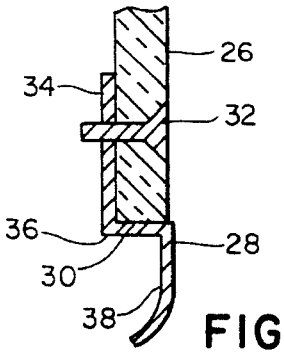
FIG. 3 is a cross-section view of the window shield of FIG. 2 showing a window shield support of the invention.
Figure 4:
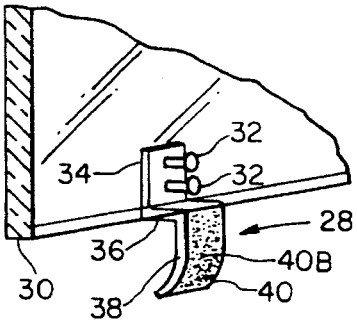
FIG. 4 is a perspective view of the window shield support of FIG. 3.

A second pair of supports 44 are spaced apart on the upper end 46 of window shield 26, as shown in FIGS. 1, 2, and 5–7. In FIG. 2, the support 44 slidably adjusts on the surface of window shield 26. A fastener 46 allows the support to move vertically, and a wing nut 48, FIG. 5, locks the support in place. Each of the supports 44 has an elongated slot 50 with a beveled edge 52 to receive a fastener 46 with a flat head having a tapered body 54 to engage beveled edge 52 in order to press the support 44 against window shield 26. Having a flat head, the fastener 46 does not project beyond the surface of support 44 and, therefore does not bind with window 18.

Figure 7:
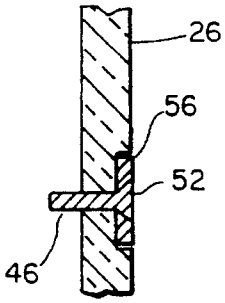
FIG. 7 is a cross-section view taken along the line 7—7 of FIG. 6.
Figure 5:
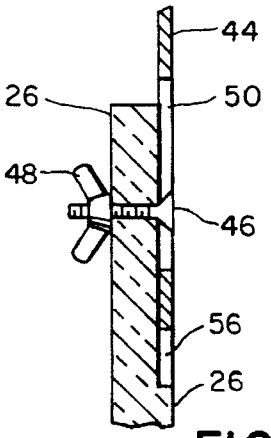
FIG. 5 is a partial cross-section view of the window shield of FIG. 2 showing an adjustable window shield support mounted on the top of the window shield.
Figure 6:
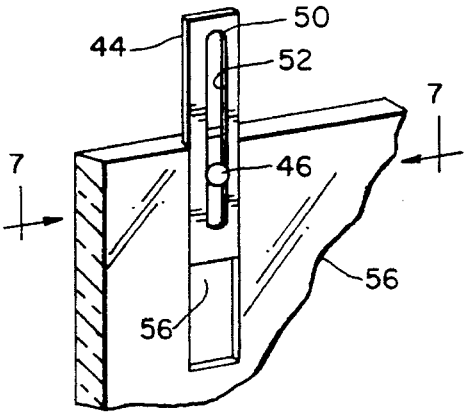
FIG. 6 is a partial perspective view showing the adjustable window shield support and window shield.

FIGS. 5, 6 and 7 show a recess 56 in window shield 26 to house support 44. Recess 56 is slightly wider and longer than support 44 so the support will move vertically freely in the recess, FIGS. 6 and 7. The length of the recess 56 is such that support 44 can be completely housed in the recess. FIG. 7 shows the depth of the recess 56 to be the thickness of support 44 thereby permitting window 18 to move past the support without binding. In addition to housing support 44 eliminating any binding that could have occured by the movement of the window 18, recess 56 also is a guide for the support which is adjustable to accomodate different window heights.

To use the window shield, window 18 is first moved to the full open position and stationary supports 28 are hooked in door frame slot 22. The window shield 26 is pivoted about the supports to fit in the window opening. Supports 44 are fully retracted either .into recess 56 or moved down beyond the edge of upper end 46 of the window shield 26. Once aligned in the opening, supports 44 are adjusted upwardly to engage in channel 14 where wing nuts 48 or some other tightening means such as knobs, handles and the like, lock the supports in place. Window 26 can now be moved vertically to close the window opening.

While the window shield has been disclosed, it is understood that others may realize other modifications and variations of the invention; therefore, one should consider the drawings, disclosure and claims for a complete understanding of the invention. The shields may be made in any suitable size to fit any window in any vehicle.

I claim:

1. A window shield for mounting on the inside of a vehicle side window to protect persons in a vehicle from injury from projectiles, comprising:

a window shield of transparent projectile resistant material of a size to substantially cover a vehicle side window opening of a vehicle door;

upper and lower support means to secure said window shield to said vehicle door having a window frame and a channel means surrounding said opening, said vehicle door having a slot means for said vehicle window to move vertically up and down within said slot means to open and close said window;

said lower support means being fixed on said window shield to engage and lock in said vehicle door slot means to prevent removal of said window shield without tilting said window shield away from the vehicle window opening;

said upper support means being vertically adjustable to secure said window shield in said vehicle window opening, where said upper support means engages said channel means and has means to lock said upper support means in said channel;

said lower support means has a downwardly projecting arcuately curved hook means to slide into said slot means and curve into said vehicle door to avoid interfering with the operation of said window and movement thereof, said arcuate curve of said hook means permitting said window to move without binding on said lower support means.

2. A window shield as in claim 1 wherein said upper support means has a slot and is captured on said window shield by a fastener means to adjust vertically.

3. A window shield as in claim 1 wherein said window shield has recesses to house said upper support means and to guide said upper support means.

4. A window shield as in claim 1 wherein said lower support means includes an L-shaped bracket for securing to said window shield by extending down said window shield across a bottom edge of said window shield, where said bracket is integrally connected to said downwardly projecting arcuately curved hook means.

* * * * *